US010584420B2

(12) United States Patent
Motomatsu et al.

(10) Patent No.: US 10,584,420 B2
(45) Date of Patent: Mar. 10, 2020

(54) SUBSTRATE LIQUID PROCESSING APPARATUS, SUBSTRATE LIQUID PROCESSING METHOD AND RECORDING MEDIUM

(71) Applicant: Tokyo Electron Limited, Tokyo (JP)

(72) Inventors: Kazuki Motomatsu, Koshi (JP); Satoshi Kaneko, Koshi (JP); Kazunori Sakamoto, Koshi (JP)

(73) Assignee: TOKYO ELECTRON LIMITED, Tokyo (JP)

( * ) Notice: Subject to any disclaimer, the term of this patent is extended or adjusted under 35 U.S.C. 154(b) by 0 days.

(21) Appl. No.: 15/633,910

(22) Filed: Jun. 27, 2017

(65) Prior Publication Data

US 2018/0002811 A1 Jan. 4, 2018

(30) Foreign Application Priority Data

Jul. 1, 2016 (JP) ..... 2016-131810

(51) Int. Cl.

| | |
|---|---|
| ***C23C 18/16*** | (2006.01) |
| ***C23C 18/18*** | (2006.01) |
| *C23C 18/38* | (2006.01) |
| *C23C 18/42* | (2006.01) |
| *C23C 18/32* | (2006.01) |

(52) U.S. Cl.

CPC ..... *C23C 18/163* (2013.01); *C23C 18/1632* (2013.01); *C23C 18/1669* (2013.01); *C23C 18/1676* (2013.01); *C23C 18/1682* (2013.01); *C23C 18/18* (2013.01); *C23C 18/32* (2013.01); *C23C 18/38* (2013.01); *C23C 18/42* (2013.01)

(58) Field of Classification Search

None

See application file for complete search history.

(56) References Cited

U.S. PATENT DOCUMENTS

| | | | | |
|---|---|---|---|---|
| 5,592,581 A * | 1/1997 | Okase | C23C 16/46 | 118/50.1 |
| 2005/0008351 A1* | 1/2005 | Gat | F27B 5/04 | 392/416 |
| 2010/0059497 A1* | 3/2010 | Ranish | F27B 17/0025 | 219/395 |

(Continued)

FOREIGN PATENT DOCUMENTS

| | | |
|---|---|---|
| JP | 09-017761 A | 1/1997 |
| JP | 2004-107747 A | 4/2004 |
| JP | 2012-136783 A | 7/2012 |

*Primary Examiner* — Charles Capozzi

(74) *Attorney, Agent, or Firm* — Pearne & Gordon LLP

(57) ABSTRACT

A substrate liquid processing apparatus 1 includes a substrate holding unit 52 configured to hold a substrate W; a processing liquid supply unit 53 configured to supply a processing liquid L1 onto a top surface of the substrate W held by the substrate holding unit 52; and a cover body 6 configured to cover the substrate W. Here, the cover body 6 includes a ceiling unit 61 disposed above the substrate W, a sidewall unit 62 downwardly extended from the ceiling unit 61, and a heating unit 63 provided at the ceiling unit 61 and configured to heat the processing liquid L1 on the substrate W. The sidewall unit 62 of the cover body 6 is placed at an outer periphery side of the substrate W when the processing liquid L1 on the substrate W is heated.

11 Claims, 8 Drawing Sheets

(56) References Cited

U.S. PATENT DOCUMENTS

2015/0090296 A1* 4/2015 Nagashima ..... H01L 21/67028
134/19
2016/0093503 A1* 3/2016 Tokuri ..... H01L 21/67051
438/745

* cited by examiner

SUBSTRATE LIQUID PROCESSING APPARATUS, SUBSTRATE LIQUID PROCESSING METHOD AND RECORDING MEDIUM

CROSS-REFERENCE TO RELATED APPLICATION

This application claims the benefit of Japanese Patent Application No. 2016-131810 filed on Jul. 1, 2016, the entire disclosures of which are incorporated herein by reference.

TECHNICAL FIELD

The embodiments described herein pertain generally to a substrate liquid processing apparatus, a substrate liquid processing method and a recording medium.

BACKGROUND

In general, there is known a substrate liquid processing apparatus which performs a liquid processing on a substrate (wafer) by using a processing liquid such as a cleaning liquid for cleaning the substrate or a plating liquid for plating the substrate. When performing the liquid processing on the substrate in this substrate liquid processing apparatus, the processing liquid may be heated. To heat the processing liquid, there is known a method of heating the processing liquid supplied on the substrate by a heater disposed above the substrate. As another way, there is also known a method of heating the processing liquid on the substrate by heating the substrate from below.

However, the processing liquid may be degraded as the temperature thereof is increased by the heating. Accordingly, if it takes time to heat the processing liquid, there may occur a problem that the processing liquid would be degraded, so that the efficiency of the liquid processing of the substrate may be deteriorated. Further, the temperature of the processing liquid on the substrate tends to become non-uniform. As a result, the rate of the liquid processing upon the substrate would be non-uniformed, which may make it difficult to achieve uniform liquid processing.

Patent Document 1: Japanese Patent Laid-open Publication No. H09-017761

Patent Document 2: Japanese Patent Laid-open Publication No. 2004-107747

Patent Document 2: Japanese Patent Laid-open Publication No. 2012-136783

SUMMARY

In view of the foregoing, exemplary embodiments provide a substrate liquid processing apparatus, a substrate liquid processing method and a recoding medium capable of suppressing degradation of a processing liquid by rapidly increasing a temperature of the processing liquid on a substrate and, also, capable of achieving uniform liquid processing of the substrate.

In one exemplary embodiment, a substrate liquid processing apparatus configured to perform a liquid processing on a substrate by supplying a processing liquid onto the substrate includes a substrate holding unit configured to hold the substrate; a processing liquid supply unit configured to supply the processing liquid onto a top surface of the substrate held by the substrate holding unit; and a cover body configured to cover the substrate held by the substrate holding unit. Here, the cover body includes a ceiling unit disposed above the substrate, a sidewall unit downwardly extended from the ceiling unit, and a heating unit provided at the ceiling unit and configured to heat the processing liquid on the substrate. The sidewall unit of the cover body is placed at an outer periphery side of the substrate when the processing liquid on the substrate is heated.

In another exemplary embodiment, a substrate liquid processing method of performing a liquid processing on a substrate by supplying a processing liquid onto the substrate includes holding the substrate; supplying the processing liquid onto a top surface of the substrate; covering the substrate with a cover body including a ceiling unit disposed above the substrate, a sidewall unit downwardly extended from the ceiling unit, and a heating unit provided at the ceiling unit; and heating the processing liquid on the substrate by the heating unit. In the heating of the processing liquid, the sidewall unit of the cover body is placed at an outer periphery side of the substrate.

In still another exemplary embodiment, there is provided a computer-readable recording medium having stored thereon computer-executable instructions that, in response to execution, cause the substrate liquid processing apparatus to perform the substrate liquid processing method as described above.

According to the exemplary embodiments, the temperature of the processing liquid on the substrate can be increased rapidly, and the liquid processing of the substrate can be uniformed.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

In the detailed description that follows, embodiments are described as illustrations only since various changes and modifications will become apparent to those skilled in the art from the following detailed description. The use of the same reference numbers in different figures indicates similar or identical items.

DETAILED DESCRIPTION

Figure 1:
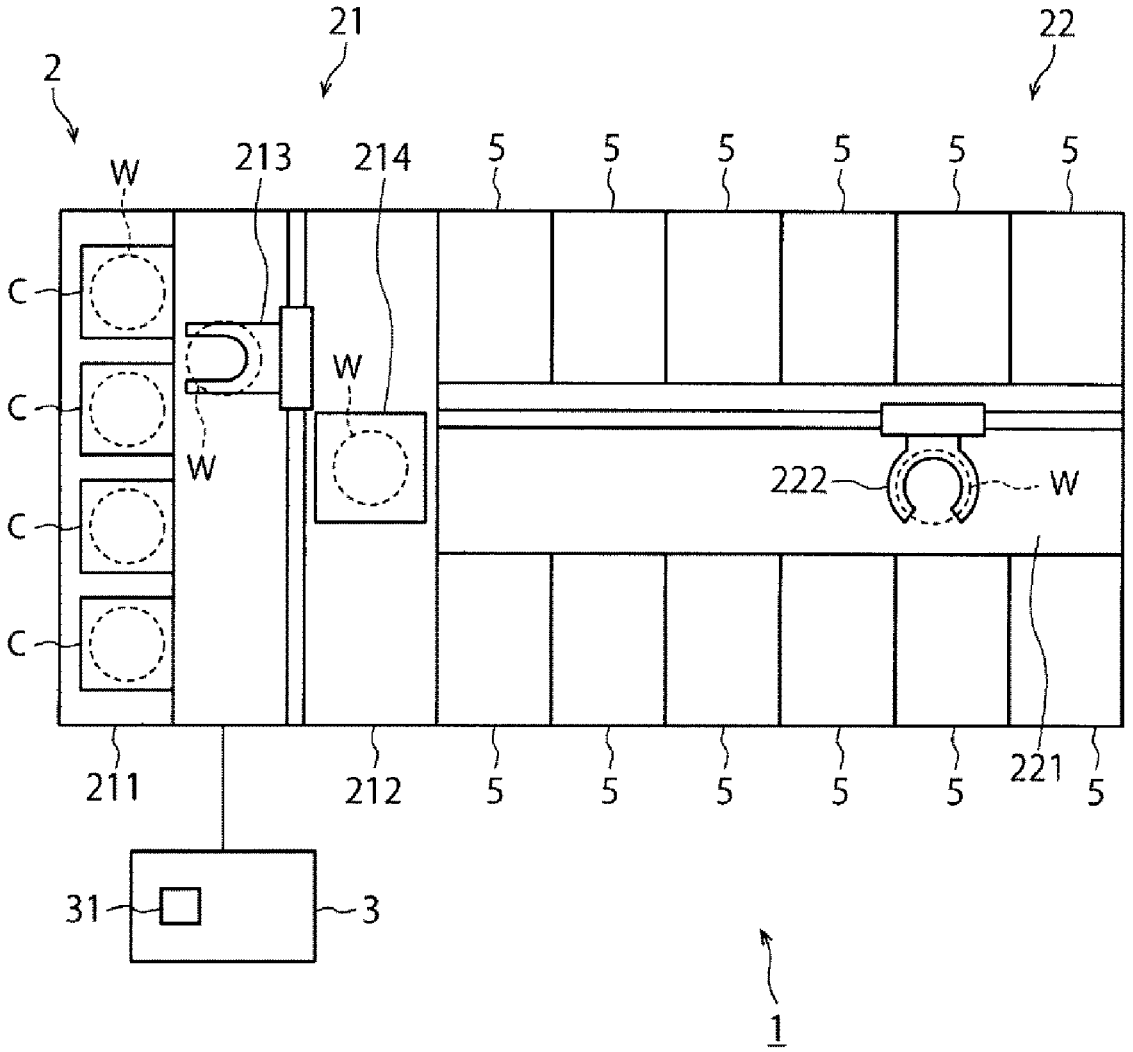
FIG. 1 is a schematic plan view illustrating a configuration of a plating apparatus.

In the following detailed description, reference is made to the accompanying drawings, which form a part of the description. In the drawings, similar symbols typically identify similar components, unless context dictates otherwise. Furthermore, unless otherwise noted, the description of each successive drawing may reference features from one or more of the previous drawings to provide clearer context and a more substantive explanation of the current exemplary embodiment. Still, the exemplary embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein and illustrated in the drawings, may be arranged, substituted, combined, separated, and designed in a wide variety of different configurations, all of which are explicitly contemplated herein.

Hereinafter, exemplary embodiments of the present disclosure will be explained in detail with reference to the accompanying drawings.

First, referring to FIG. 1, a configuration of a substrate liquid processing apparatus according to an exemplary embodiment will be described. FIG. 1 is a schematic diagram illustrating a configuration of a plating apparatus as an example of the substrate liquid processing apparatus of the exemplary embodiment. Here, the plating apparatus is configured to perform a plating processing (liquid processing) on a substrate W by supplying a plating liquid L1 (processing liquid) onto the substrate W.

As depicted in FIG. 1, the plating apparatus 1 according to the exemplary embodiment includes a plating unit 2 and a controller 3 configured to control an operation of the plating unit 2.

The plating unit 2 is configured to perform various processings on the substrate W. The various processings performed by the plating unit 2 will be described later.

The controller 3 is implemented by, for example, a computer, and includes an operation controller and a storage unit. The operation controller is implemented by, for example, a CPU (Central Processing Unit) and is configured to control the operation of the plating unit 2 by reading and executing a program stored in the storage unit. The storage unit is implemented by a storage device such as, but not limited to, a RAM (Random Access Memory), a ROM (Read Only Memory) or a hard disk, and stores thereon a program for controlling various processings performed in the plating unit 2. Further, the program may be recorded in a computer-readable recording medium 31, or may be installed from the recording medium 31 to the storage unit. The computer-readable recording medium 31 may be, for example, a hard disc (HD), a flexible disc (FD), a compact disc (CD), a magnet optical disc (MO), or a memory card. The recording medium 31 has stored thereon a program that, when executed by a computer for controlling an operation of the plating apparatus 1, causes the plating apparatus 1 to perform a plating method to be described later under the control of the computer.

Referring to FIG. 1, a configuration of the plating unit 2 will be discussed. FIG. 1 is a schematic plan view illustrating the configuration of the plating unit 2.

The plating unit 2 includes a carry-in/out station 21; and a processing station 22 provided adjacent to the carry-in/out station 21.

The carry-in/out station 21 includes a placing section 211; and a transfer section 212 provided adjacent to the placing section 211.

In the placing section 211, multiple transfer containers (hereinafter, referred to as "carriers C") each of which accommodates therein a plurality of substrates W horizontally is placed.

The transfer section 212 is provided with a transfer device 213 and a delivery unit 214. The transfer device 213 is provided with a holding mechanism configured to hold a substrate W. The transfer device 213 is configured to be movable horizontally and vertically and pivotable around a vertical axis.

The processing station 22 includes plating devices 5. In the present exemplary embodiment, the number of the plating devices 5 provided in the processing station 22 may be two or more, but it is also possible to provide only one plating device 5. The plating devices 5 are arranged at both sides of a transfer path 221 which is extended in a preset direction (at both sides in a direction perpendicular to a moving direction of a transfer device 22 to be described later).

The transfer path 221 is provided with a transfer device 222. The transfer device 222 includes a holding mechanism configured to hold a substrate W, and is configured to be movable horizontally and vertically and pivotable around a vertical axis.

In the plating unit 2, the transfer device 213 of the carry-in/out station 21 is configured to transfer the substrate W between the carrier C and the delivery unit 214. To elaborate, the transfer device 213 takes out the substrate W from the carrier C placed in the placing section 211, and then, places the substrate W in the delivery unit 214. Further, the transfer device 213 takes out the substrate W which is placed in the delivery unit 214 by the transfer device 222 of the processing station 22, and then, accommodates the substrate W in the carrier C of the placing section 211.

In the plating unit 2, the transfer device 222 of the processing station 22 is configured to transfer the substrate W between the delivery unit 214 and the plating device 5 and between the plating device 5 and the delivery unit 214. To elaborate, the transfer device 222 takes out the substrate W placed in the delivery unit 214 and carries the substrate W into the plating device 5. Further, the transfer device 222 takes out the substrate W from the plating device 5 and places the substrate W in the delivery unit 214.

Figure 2:
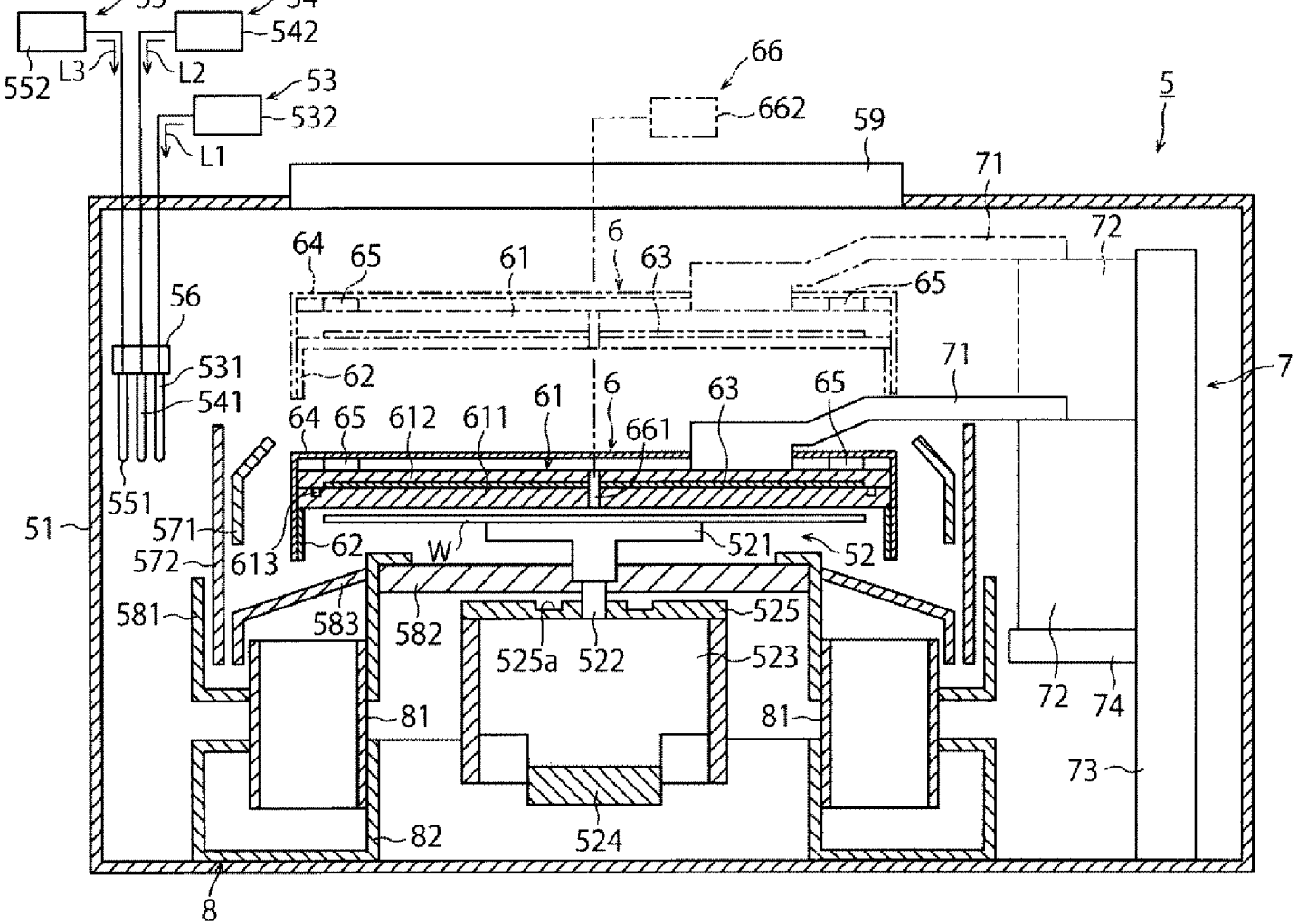
FIG. 2 is a cross sectional view illustrating a configuration of a plating device shown in FIG. 1.

Now, a configuration of the plating device 5 will be explained. FIG. 2 is a schematic cross sectional view illustrating the configuration of the plating device 5.

The plating device 5 is configured to perform a liquid processing including an electroless plating processing. The plating device 5 includes a chamber 51; a substrate holding unit 52 provided within the chamber 51 and configured to hold a substrate W horizontally; and a plating liquid supply unit 53 (processing liquid supply unit) configured to supply a plating liquid L1 (processing liquid) to a top surface of the substrate W held by the substrate holding unit 52. In the present exemplary embodiment, the substrate holding unit 52 is equipped with a chuck member 521 configured to vacuum-attract a bottom surface (rear surface) of the substrate W. This chuck member 521 is configured to be of a so-called vacuum chuck type. However, the exemplary embodiment is not limited thereto, and the substrate holding unit 52 may be of a so-called mechanical chuck type in which an edge portion of the substrate W is held by a chuck device or the like.

The substrate holding unit 52 is connected to a rotation motor 523 (rotational driving unit) via a rotation shaft 522. If the rotation motor 523 is driven, the substrate holding unit 52 is rotated along with the substrate W thereon. The rotation motor 523 is supported at a base 524 fixed to the chamber 51.

Figure 3:
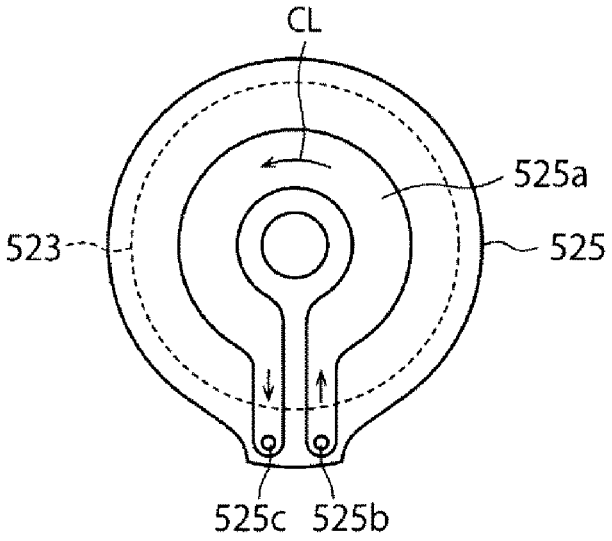
FIG. 3 is a plan view showing a cooling plate of FIG. 2.

A cooling plate 525 is provided on the rotation motor 523. A cooling groove 525*a* in which a cooling liquid (CL) (for example, cooling water) flows is provided in a top surface of the cooling plate 525. As shown in FIG. 3, the cooling groove 525*a* is formed to surround the rotation shaft 522, when viewed from the top. A cooling liquid inlet 525*b* is provided at one end of the cooling groove 525*a*, and a cooling liquid outlet 525*c* is provided at the other end thereof. With this configuration, the cooling liquid CL supplied from a non-illustrated cooling liquid supply source is introduced into the cooling groove 525*a* through the cooling liquid inlet 525*b* and is flown out from the cooling liquid outlet 525*c* after flowing through the cooling groove 525*a*. While the cooling liquid CL flows in the cooling groove 525*a*, heat is transferred between the rotation motor 523 and the cooling liquid CL, so that the rotation motor 523 is cooled and a temperature rise of the rotation motor 523 is suppressed.

As depicted in FIG. 2, the plating liquid supply unit 53 is equipped with a plating liquid nozzle 531 (processing liquid nozzle) configured to discharge (supply) the plating liquid L1 onto the substrate W held by the substrate holding unit 52; and a plating liquid supply source 532 configured to supply the plating liquid L1 to the plating liquid nozzle 531. The plating liquid supply source 532 is configured to supply the plating liquid L1 heated to or adjusted to have a preset temperature to the plating liquid nozzle 531. A temperature of the plating liquid L1 at a time when it is discharged from the plating liquid nozzle 531 is, for example, in the range from 55° C. to 75° C., and, more desirably, in the range from 60° C. to 70° C. The plating liquid nozzle 531 is held by the nozzle arm 56 and is configured to be movable.

The plating liquid L1 is an autocatalytic (reduction) plating liquid for electroless plating. The plating liquid L1 contains a metal ion such as a cobalt (Co) ion, a nickel (Ni) ion, a tungsten (W) ion, a copper (Cu) ion, a palladium (Pd) ion or a gold (Au) ion; and a reducing agent such as hypophosphorous acid or dimethylamineborane. The plating liquid L1 may further contain an additive or the like. A plating film P (metal film, see FIG. 9E) formed by the plating processing with the plating liquid L1 may be, by way of non-limiting example, CoWB, CoB, CoWP, CoWBP, NiWB, NiB, NiWP, NiWBP, or the like.

The plating device 5 according to the present exemplary embodiment further includes, as another processing liquid supply unit, a cleaning liquid supply unit 54 configured to supply a cleaning liquid L2 onto the top surface of the substrate W held by the substrate holding unit 52; and a rinse liquid supply unit 55 configured to supply a rinse liquid L3 onto the top surface of the substrate W.

The cleaning liquid supply unit 54 is equipped with a cleaning liquid nozzle 541 configured to discharge the cleaning liquid L2 onto the substrate W held by the substrate holding unit 52; and a cleaning liquid supply source 542 configured to supply the cleaning liquid L2 to the cleaning liquid nozzle 541. As an example of the cleaning liquid L2, an organic acid such as a formic acid, malic acid, a succinic acid, a citric acid or a malonic acid, or a hydrofluoric acid (DHF) (aqueous solution of hydrogen fluoride) diluted to the extent that it does not corrode a plating target surface of the substrate W may be used. The cleaning liquid nozzle 541 is held by the nozzle arm 56 and is configured to be movable along the plating liquid nozzle 531.

The rinse liquid supply unit 55 is equipped with a rinse liquid nozzle 551 configured to supply the rinse liquid L3 onto the substrate W held by the substrate holding unit 52; and a rinse liquid supply source 552 configured to supply the rinse liquid L3 to the rinse liquid nozzle 551. The rinse liquid nozzle 551 is held by the nozzle arm 56 and is configured to be movable along with the plating liquid nozzle 531 and the cleaning liquid nozzle 541. As an example of the rinse liquid L3, pure water or the like may be used.

Figure 4:
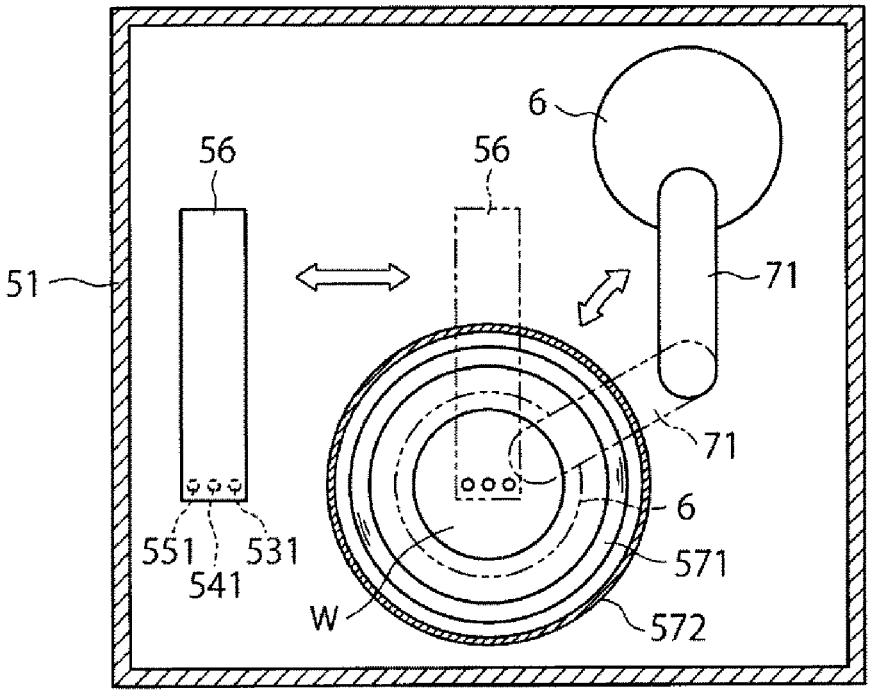
FIG. 4 is a cross sectional plan view showing a nozzle arm and a cover body of FIG. 2.

The nozzle arm 56 holding the aforementioned plating liquid nozzle 531, cleaning liquid nozzle 541 and rinse liquid nozzle 551 is connected to a non-illustrated nozzle moving mechanism. The nozzle moving mechanism is configured to move the nozzle arm 56 in the horizontal direction and in the vertical direction. To be elaborate, as shown in FIG. 4, the nozzle arm 56 is configured to be movable by the nozzle moving mechanism between a discharge position (indicated by a dashed double-dotted line in FIG. 4) where the processing liquid (plating liquid L1, cleaning liquid L2 or rinse liquid L3) is discharged onto the substrate W and a retreat position (indicated by a solid line in FIG. 4) retreated from the discharge position. The discharge position is not particularly limited as long as the processing liquid can be supplied onto a certain position on the top surface of the substrate W. By way of example, it is desirable that the discharge position is set to a position where the processing liquid can be supplied to a center of the substrate W. The discharge position of the nozzle arm 56 may be set differently among the individual cases of supplying the plating liquid L1, supplying the cleaning liquid L2 and supplying the rinse liquid L3 to the substrate W. The retreat position is a position within the chamber 51 which is not overlapped with the substrate W when viewed from above and is spaced apart from the discharge position. If the nozzle arm 56 is located at the retreat position, interference between the cover body 6 being moved and the nozzle arm 56 can be avoided.

A cup 571 is disposed around the substrate holding unit 52. The cup 57 is formed in a ring shape when viewed from above, and is configured to receive the processing liquid scattered from the substrate W when the substrate W is rotated and configured to guide the received processing liquid to a drain duct 581 to be described later. An atmosphere blocking cover 572 is provided at an outer periphery side of the cup 571 and suppresses the ambient atmosphere around the substrate W from being diffused into the chamber 51. The atmosphere blocking cover 572 is formed to have a vertically extended cylindrical shape and has an open top. A cover body 6 to be descried later can be inserted into the atmosphere blocking cover 572 from above.

The drain duct 581 is provided under the cup 571. When viewed from above, the drain duct 581 is formed in a ring shape, and serves to receive and drain the processing liquid falling down after being received by the cup 571 and the processing liquid directly falling from the vicinity of the substrate W. Provided at the inner periphery side of the drain duct 581 is an inner cover 582. This inner cover 582 is disposed above the cooling plate 525 and suppresses diffusion of the processing liquid and the ambient atmosphere around the substrate W. A guide member 583 configured to guide the processing liquid into the drain duct 581 is provided above an exhaust line 81 to be described later. The guide member 583 suppresses the processing liquid falling in a space above the exhaust line 81 from entering the exhaust line 81 but allows this processing liquid to be received into the drain duct 581.

The substrate W held by the substrate holding unit 52 is covered by the cover body 6. The cover body 6 has a ceiling unit 61; and a sidewall unit 62 extended downwards from the ceiling unit 61. The ceiling unit 61 is located above the substrate W held by the substrate holding unit 52 when the cover body 6 is located at a first gap position or a second gap position to be described later, and faces the substrate W with a relatively small gap therebetween.

The ceiling unit 61 includes a first ceiling plate 611 and a second ceiling plate 612 provided on the first ceiling plate 611. A heater 63 (heating unit) to be described later is provided between the first ceiling plate 611 and the second ceiling plate 612. The first ceiling plate 611 and the second ceiling plate 612 are configured to seal the heater 63, so that the heater 63 is suppressed from coming into contact with the processing liquid such as the plating liquid L1. To be more specific, a seal ring 613 is provided at an outer periphery side of the heater 63 between the first ceiling plate 611 and the second ceiling plate 612, and the heater 63 is sealed by the seal ring 613. It is desirable that the first ceiling plate 611 and the second ceiling plate 612 have corrosion resistance against the processing liquid such as the plating liquid L1 and may be made of, by way of non-limiting example, an aluminium alloy. Further, to improve the corrosion resistance, the first ceiling plate 611, the second ceiling plate 612 and the sidewall unit 62 may be coated with Teflon (registered trademark).

The cover body 6 is connected to a cover body moving device 7 via a cover body arm 71. The cover body moving device 7 is configured to move the cover body 6 in the horizontal direction and in the vertical direction. To elaborate, the cover body moving device 7 is equipped with a swing motor 72 configured to move the cover body 6 in the horizontal direction and a cylinder 73 (gap adjusting unit) configured to move the cover body 6 in the vertical direction. The swing motor 72 is mounted on a supporting plate 74 which is configured to be movable up and down with respect to the cylinder 73. Here, instead of the cylinder 73, an actuator (not shown) including a motor and a ball screw may be utilized.

As depicted in FIG. 4, the swing motor 72 of the cover body moving device 7 is configured to move the cover body 6 between an up position (indicated by a dashed double-dotted line in FIG. 4) located above the substrate W held by the substrate holding unit 52 and a retreat position (indicated by a solid line in FIG. 4) retreated from the up position. The up position is a position facing the substrate W, which is held by the substrate holding unit 52, with a relatively large gap therebetween and overlapped with the substrate W when viewed from above. The retreat position is a position, within the chamber 51, which is not overlapped with the substrate W when viewed from above. In case that the cover body 6 is located at the retreat position, interference between the nozzle arm 56 being moved and the cover body 6 is avoided. A rotation axis of the swing motor 72 is vertically extended, and the cover body 6 is configured to be revolved in the horizontal direction between the up position and the retreat position.

As shown in FIG. 2, the cylinder 73 of the cover body moving device 7 is configured to move the cover body 6 up and down and adjust a distance between the first ceiling plate 611 of the ceiling unit 61 and the substrate W on which the plating liquid L1 is supplied. To be specific, the cylinder 73 locates the cover body 6 at the first gap position (see FIG. 9C), the second gap position (see FIG. 9D) and the aforementioned up position (indicated by a dashed double-dotted line in FIG. 2).

At the first gap position, a gap between the substrate W and the first ceiling plate 611 becomes a first gap g1 (see FIG. 9C) which is the smallest, and the first ceiling plate 611 comes closest to the substrate W. In this case, in order to suppress contamination and loss of the plating liquid L1 or to suppress generation of bubbles in the plating liquid L1, it is desirable to set the first gap g1 such that the first ceiling plate 611 does not come into contact with the plating liquid L1 on the substrate W.

At the second gap position, the gap between the substrate W and the first ceiling plate 611 becomes a second gap g2 (see FIG. 9D) which is larger than the first gap g1. Accordingly, the cover body 6 is located at a position above the first gap position.

At the up position, the gap between the substrate W and the first ceiling plate 611 becomes larger than the second gap g2, and the cover body 6 is located at a position above the second gap position. That is, the up position is set to a position where interference of the cover body 6 with the ambient structures such as the cup 571 and the atmosphere blocking cover 572 can be avoided when the cover body 6 is revolved in the horizontal direction.

The cover body 6 is configured to be movable among the first gap position, the second gap position and the up position by the cylinder 73. In the present exemplary embodiment, when the cover body 6 is located at the first gap position or the second gap position, the heater 63 is driven to heat the plating liquid L1 on the substrate W. That is to say, the cylinder 73 is capable of adjusting the distance between the substrate W and the first ceiling plate 611 to the first gap g1 or the second gap g2 when the plating liquid L1 on the substrate W is heated.

As illustrated in FIG. 2, the sidewall unit 62 of the cover body 6 is extended downwards from an edge of the first ceiling plate 611 of the ceiling unit 61, and is located near an outer periphery of the substrate W when the plating liquid L1 on the substrate W is heated (that is, when the cover body 6 is located at the first gap position or the second gap position). In case that the cover body 6 is placed at the first gap position, a lower end 621 of the sidewall unit 62 is located at a position lower than the substrate W, as shown in FIG. 9C. In this case, a distance x1 between the lower end 621 of the sidewall unit 62 and a bottom surface of the substrate W in the vertical direction may be set to range from, for example, 10 mm to 30 mm, desirably. As illustrated in FIG. 9D, even when the cover body 6 is located at the second gap position, the lower end 621 of the sidewall unit 62 is positioned lower than the substrate W. In this case, a distance x2 between the lower end 621 of the sidewall unit 62 and the bottom surface of the substrate W in the vertical direction may be set to be, for example, 4 mm to 5 mm, desirably.

As shown in FIG. 2, the heater 63 is provided in the ceiling unit 61 of the cover body 6. The heater 63 heats the processing liquid (appropriately, the plating liquid L1) on the substrate W when the cover body 6 is located at the first gap position or the second gap position. In the present exemplary embodiment, the heater 63 is embedded between the first ceiling plate 611 and the second ceiling plate 612 of the cover body 6. The heater 63 is sealed as stated above and is suppressed from being brought into contact with the processing liquid such as the plating liquid L1.

Figure 5:
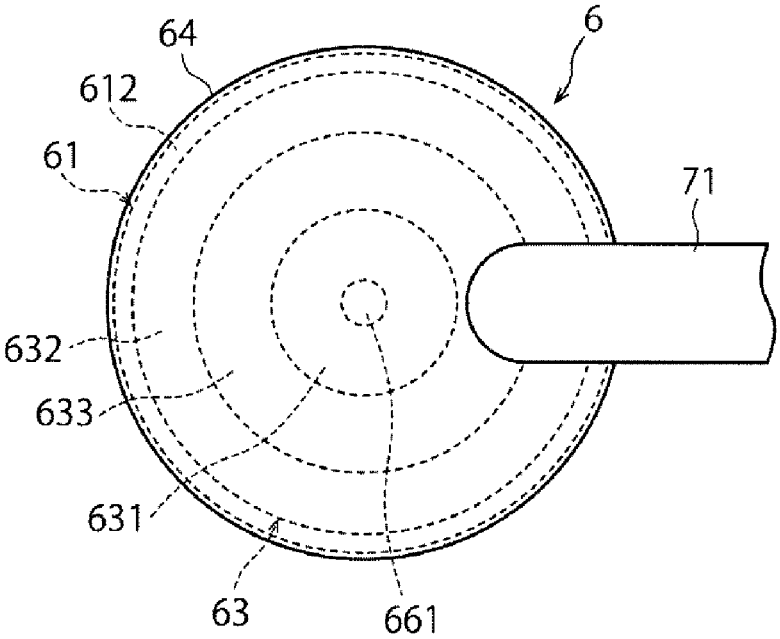
FIG. 5 is a plan view illustrating a heater of FIG. 2.

As depicted in FIG. 5, the heater 63 includes an inner heater 631 (inner heating unit); an outer heater 632 (outer heating unit) provided at an outer periphery side than the inner heater 631; and an intermediate heater 633 (intermediate heating unit) provided between the inner heater 631 and the outer heater 632. The inner heater 631, the outer heater 632 and the intermediate heater 633 are separated from each other and are configured to be driven independently. Further, when viewed from above, the inner heater 631, the outer heater 632 and the intermediate heater 633 are formed to have ring shapes and are concentrically arranged. For example, each of the heaters 631, 632 and 633 may be implemented by MICA HEATER which is a sheet-shaped heating element.

A calorific power per unit area of at least one of the inner heater 631 and the outer heater 632 is larger than a calorific power per unit area of the intermediate heater 633. Appropriately, the calorific powers per unit area of both the inner heater 631 and the outer heater 632 are larger than the calorific power per unit area of the intermediate heater 633. In this case, heater capacities per unit area of the inner heater 631 and the outer heater 632 may be set to be larger than a heater capacity per unit area of the intermediate heater 633. Alternatively, if the individual heaters 631, 632 and 633 have the same heater capacity, electric powers supplied to the inner heater 631 and the outer heater 632 may be set to be larger than an electric power supplied to the intermediate heater 633.

As shown in FIG. 2, according to the present exemplary embodiment, an inert gas (e.g., a nitrogen ($N_2$) gas) is supplied to the inside of the cover body 6 by an inert gas supply unit 66. The inert gas supply unit 66 is equipped with a gas nozzle 661 configured to discharge the inert gas to the inside of the cover body 6; and an inert gas supply source 662 configured to supply the inert gas to the gas nozzle 661. The gas nozzle 661 is provided at the ceiling unit 61 of the cover body 6 and discharges the inert gas toward the substrate W in the state that the cover body 6 covers the substrate W.

The ceiling unit 61 and the sidewall unit 62 of the cover body 6 are covered by the cover body cover 64. The cover body cover 64 is provided on the second ceiling plate 612 of the cover body 6 with supporting portions 65 therebetween. That is, a multiple number of supporting portions 65 protruded upwards from a top surface of the second ceiling plate 612 are provided on the second ceiling plate 612, and the cover body cover 64 is placed on these supporting portions 65. The cover body cover 64 is configured to be movable in the horizontal direction and in the vertical direction along with the cover body 6. Further, it is desirable that the cover body cover 64 has higher heat insulation property than the ceiling unit 61 and the sidewall unit 62 to suppress heat within the cover body 6 from being leaked to the vicinity thereof. By way of non-limiting example, the cover body cover 64 may be made of a resin material, and it is more desirable that the resin material has heat resistance.

As depicted in FIG. 2, a fan filter unit 59 (gas supply unit) configured to supply clean air (gas) to the vicinity of the cover body 6 is provided at a top portion of the chamber 51. The fan filter unit 59 supplies air into the chamber 51 (particularly, into the atmosphere blocking cover 572), and the supplied air flows toward the exhaust line 81 to be described later. A downflow of this air is formed in the vicinity of the cover body 6, and a gas vaporized from the processing liquid such as the plating liquid L1 is flown toward the exhaust line 81 along with this downflow. Accordingly, the gas vaporized from the processing liquid is suppressed from moving up and diffusing within the chamber 51.

In the present exemplary embodiment, a supply amount of the gas from the fan filter unit 59 at a time when the plating liquid L1 on the substrate W is heated by the heater 63 is set to be smaller than a supply amount of the gas from the fan filter unit 59 at a time when the plating liquid L1 is supplied onto the substrate W. To be more specific, when the cover body 6 is located at the first gap position or the second gap position, the supply amount of the air from the fan filter unit 59 is smaller than the supply amount of the air at a time when the cover body 6 is located at the retreat position or the up position.

Figure 6:
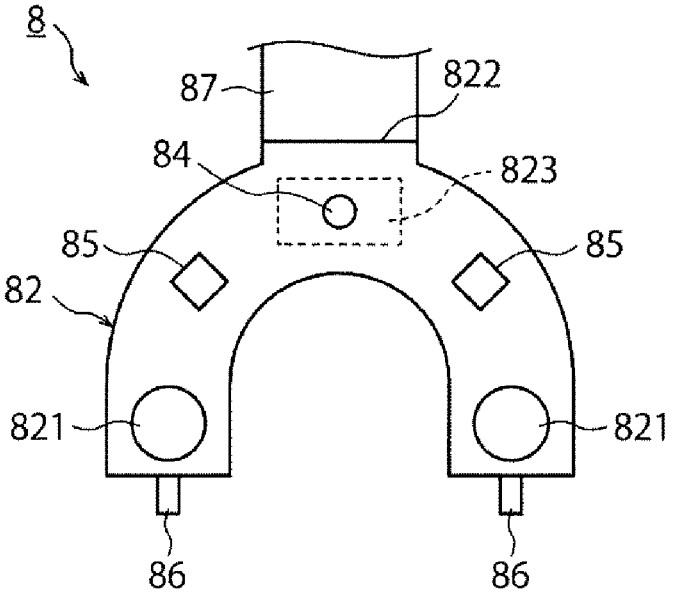
FIG. 6 is a plan view illustrating a gas exhaust device of FIG. 2.

The gas supplied from the aforementioned fan filter unit 59 is exhausted by a gas exhaust device 8. The gas exhaust device 8 includes, as shown in FIG. 2, two exhaust lines 81 provided under the cup 571; and an exhaust duct 82 provided under the drain duct 581. The two exhaust lines 81 penetrate a bottom portion of the drain duct 581 and individually communicate with the exhaust duct 82. As illustrated in FIG. 6, the exhaust duct 82 is formed to have a substantially semi-circular ring shape when viewed from above. In the present exemplary embodiment, the single exhaust duct 82 is provided under the drain duct 581, and the two exhaust lines 81 communicate with this exhaust duct 82.

Referring to FIG. 6, the exhaust duct 82 includes two exhaust gas inlets 821 and a single exhaust gas outlet 822. To elaborate, the exhaust gas inlets 821 are provided at both end portions of the exhaust duct 82 in the circumferential direction, and the exhaust gas outlet 822 is provided at a middle portion of the exhaust duct 82. A second exhaust duct 87 is connected to the exhaust gas outlet 822, and a gas within the exhaust duct 82 is exhausted through the second exhaust duct 87.

Figure 7:
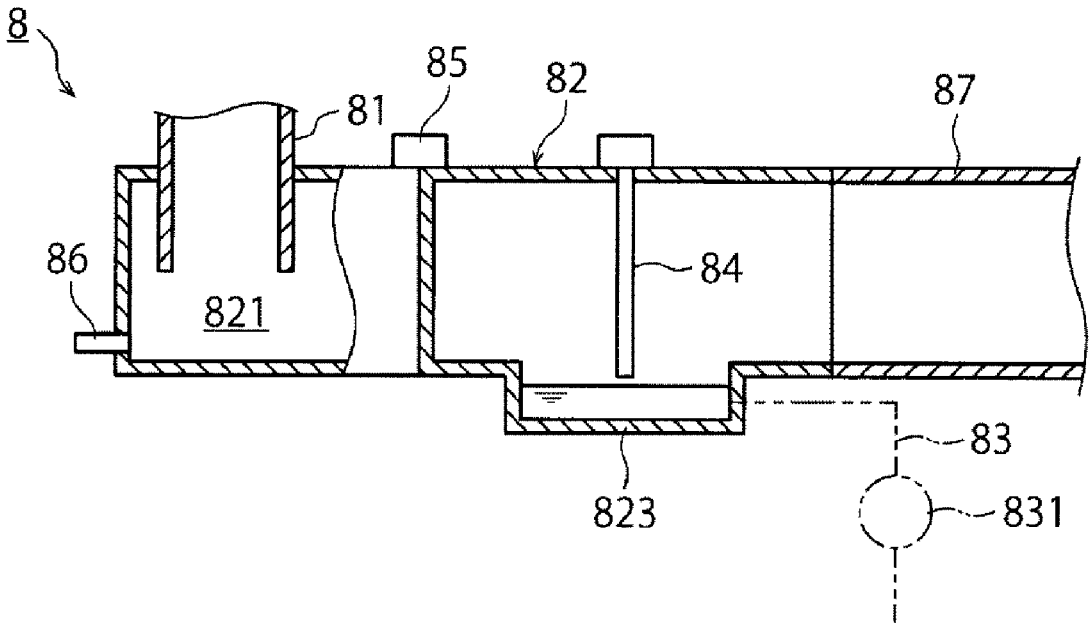
FIG. 7 is a partial cross sectional view illustrating the gas exhaust device of FIG. 6.
Figure 8:
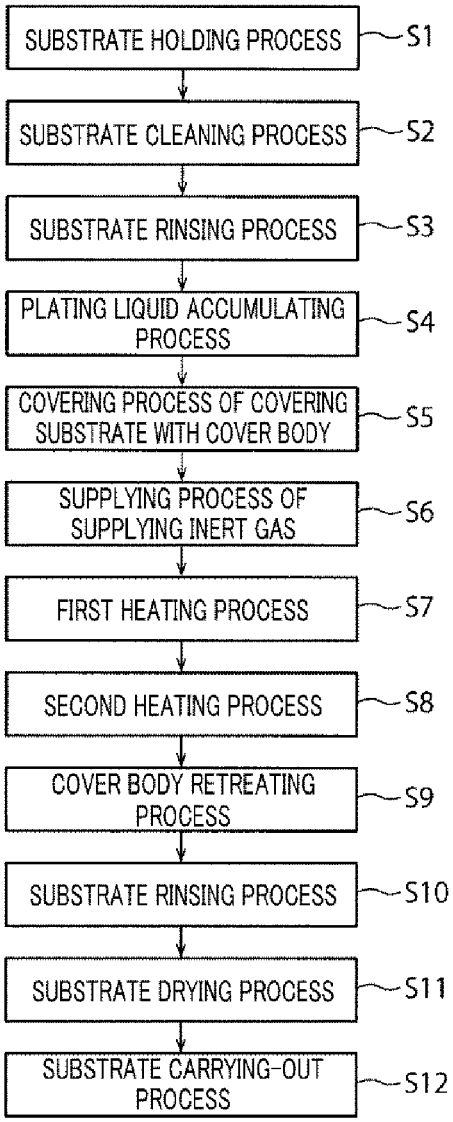
FIG. 8 is a flowchart for describing a plating processing of a substrate in the plating apparatus of FIG. 1.

As shown in FIG. 6 and FIG. 7, a duct recess 823 is provided at the middle portion of the exhaust duct 82 (that is, near the exhaust gas outlet 822). The duct recess 823 is provided in a bottom portion of the exhaust duct 82 and stores the processing liquid (the plating liquid L1, the cleaning liquid L2 or the rinse liquid L3) introduced into the exhaust duct 82 after passing through the exhaust lines 81. A liquid drain line 83 is connected to the duct recess 823. The liquid drain line 83 includes a liquid drain pump 831 and is configured to drain out the processing liquid stored in the duct recess 823.

As illustrated in FIG. 7, a liquid surface sensor 84 is provided in the duct recess 823. The liquid surface sensor 84 is configured to detect a liquid surface of the processing liquid stored in the duct recess 823. Further, a pressure sensor 85 configured to detect a pressure is provided in the exhaust duct 82. Furthermore, the exhaust duct 82 is equipped with a duct nozzle 86, and a duct cleaning liquid (e.g., water) is discharged into the exhaust duct 82 from the duct nozzle 86. Accordingly, the inside of the exhaust duct 82 can be cleaned with the duct cleaning liquid.

An operation of the present exemplary embodiment having the above-described configuration will be explained with reference to FIG. 8 and FIG. 9A to FIG. 9E. Here, as an example of a substrate liquid processing method, a plating method using the plating apparatus 1 will be discussed.

The plating method performed by the plating apparatus 1 includes a plating processing upon a substrate W. The plating processing is performed by the plating device 5. An operation of the plating device 5 to be described below is controlled by the controller 3. Further, while the following processings are being performed, the clean air is supplied into the chamber 51 from the fan filter unit 59 and flows toward the exhaust lines 81. Furthermore, the cooling liquid CL is flown in the cooling groove 525*a* of the cooling plate 525 provided on the rotation motor 523, so that the rotation motor 523 is cooled.

[Substrate Holding Process]

Figure 9A:
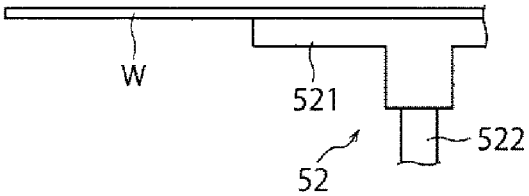
FIG. 9A is a diagram for describing a substrate holding process of FIG. 8.

First, a substrate W is carried into the plating device 5 and is held by the substrate holding unit 52, as shown in FIG. 9A (process 51). Here, a bottom surface of the substrate W is vacuum-attracted, and the substrate W is horizontally held by the substrate holding unit 52.

[Substrate Cleaning Process]

Then, the substrate W held by the substrate holding unit 52 is cleaned (process S2). In this case, the rotation motor 523 is first driven and the substrate W is rotated at a preset rotational speed. Subsequently, the nozzle arm 56 placed at the retreat position (indicated by the solid line in FIG. 4) is moved to the discharge position (indicated by the dashed double-dotted line in FIG. 4). Then, the cleaning liquid L2 is supplied from the cleaning liquid nozzle 541 onto the substrate W being rotated, so that the surface of the substrate W is cleaned. As a result, foreign substances adhering to the substrate W are removed from the substrate W. The cleaning liquid L2 supplied to the substrate W is introduced into the drain duct 581.

[Substrate Rinsing Process]

Subsequently, the cleaned substrate W is rinsed (process S3). In this case, the rinse liquid L3 is supplied from the rinse liquid nozzle 551 onto the substrate W being rotated, so that the surface of the substrate W is rinsed. As a result, the cleaning liquid L2 remaining on the substrate W is washed away. The rinse liquid L3 supplied to the substrate W is introduced into the drain duct 581.

[Plating Liquid Accumulating Process]

Afterwards, as a plating liquid accumulating process, the plating liquid L1 is supplied to and accumulated on the rinsed substrate W. In this case, the rotational speed of the substrate W is reduced smaller than the rotational speed of the substrate W in the substrate rinsing process. By way of example, but not limitation, the rotational speed of the substrate W may be set to be in the range from 50 rpm to 150 rpm. Accordingly, a plating film P formed on the substrate W as will be described later can be uniformed. Further, the rotation of the substrate W may be stopped to increase an accumulation amount of the plating liquid L1.

Figure 9B:
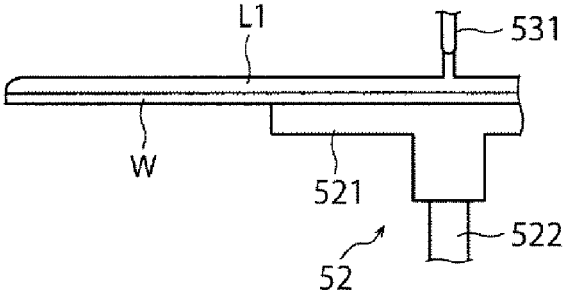
FIG. 9B is a diagram for describing a plating liquid accumulating process of FIG. 8.
Figure 9C:
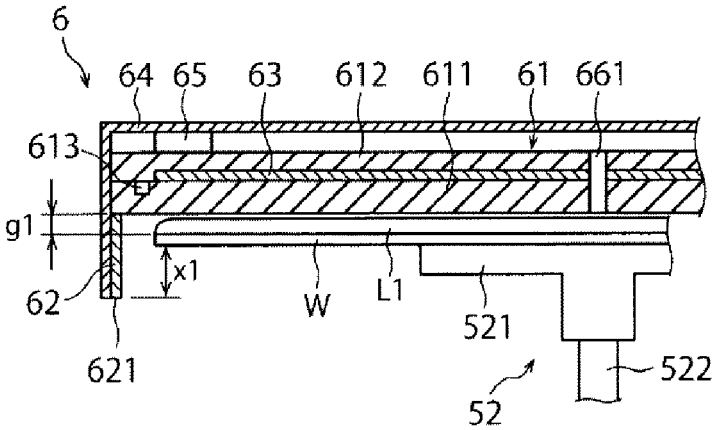
FIG. 9C is a diagram for describing a first heating process of FIG. 8.
Figure 9D:
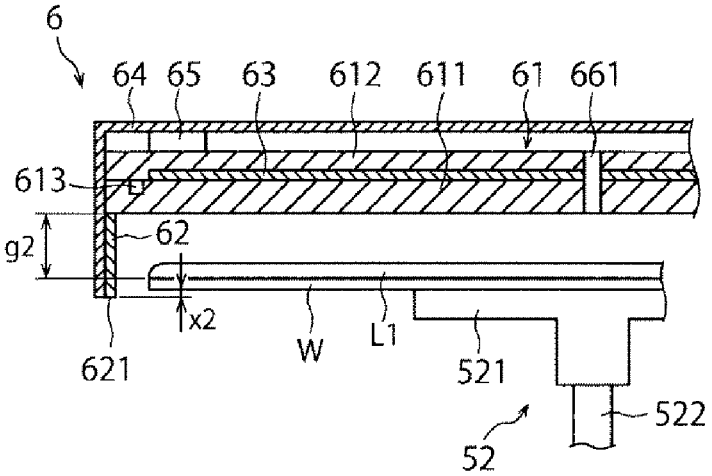
FIG. 9D is a diagram for describing a second heating process of FIG. 8.

Subsequently, as shown in FIG. 9B, the plating liquid L1 is discharged onto the top surface of the substrate W from the plating liquid nozzle 531. As the discharged plating liquid L1 stays on the top surface of the substrate W by a surface tension, the plating liquid L1 is accumulated on the top surface of the substrate W, so that a layer (a so-called paddle) of the plating liquid L1 is formed thereon. A part of the plating liquid L1 is flown off the top surface of the substrate W and is drained through the drain duct 581. After a preset amount of the plating liquid L1 is discharged from the plating liquid nozzle 531, the discharge of the plating liquid L1 is stopped.

Thereafter, the nozzle arm 56 placed at the discharge position is returned back to the retreat position.

[Plating Liquid Heating Process]

Thereafter, as a plating liquid heating process, the plating liquid L1 accumulated on the substrate W is heated. This plating liquid heating process includes a covering process (process S5) of covering the substrate W with the cover body 6; a supplying process (process S6) of supplying the inert gas; a first heating process (process S7) of heating the plating liquid L1 while setting the gap between the substrate W and the first ceiling plate 611 to the first gap g1; a second heating process (process S8) of heating the plating liquid L1 while setting the gap between the substrate W and the first ceiling plate 611 to the second gap g2; and a cover body retreating process of retreating the cover body 6 from the substrate W (process S9). Further, in this plating liquid heating process as well, it is desirable to maintain the rotational speed of the substrate W equal to that in the plating liquid accumulating process (or to stop the rotation of the substrate W).

<Covering Process of Covering Substrate with Cover Body>

First, the substrate W is covered by the cover body 6 (process S5). In this case, the swing motor 72 of the cover body moving device 7 is driven, and the cover body 6 placed at the retreat position (indicated by the solid line in FIG. 4) is rotated in the horizontal direction to be placed at the up position (indicated by the dashed double-dotted line in FIG. 4).

Subsequently, as illustrated in FIG. 9C, as the cylinder 73 of the cover body moving device 7 is driven, the cover body 6 located at the up position is lowered and placed at the first gap position. Accordingly, the gap between the substrate W and the first ceiling plate 611 of the cover body 6 becomes the first gap g1, and the sidewall unit 62 of the cover body 6 is placed near the outer periphery side of the substrate W. In the present exemplary embodiment, the lower end 621 of the sidewall unit 62 of the cover body 6 is located at a position lower than the bottom surface of the substrate W. Accordingly, the substrate W is covered by the cover body 6, so that the space around the substrate W is sealed.

<Supplying Process of Supplying Inert Gas>

After the substrate W is covered by the cover body 6, the gas nozzle 661 provided at the ceiling unit 61 of the cover body 6 discharges the inert gas to the inside of the cover body 6 (process S6). Accordingly, the atmosphere of the inside of the cover body 6 is replaced by the inert gas, and the vicinity of the substrate W is turned into the low oxygen atmosphere. The inert gas is discharged for a preset time period. Upon the lapse of the preset time period, the discharge of the inert gas is stopped.

<First Heating Process>

Subsequently, as the first heating process, the plating liquid L1 accumulated on the substrate W is heated (process S7). In the first heating process, the inner heater 631, the outer heater 632 and the intermediate heater 633 are driven, so that the plating liquid L1 accumulated on the substrate W is heated. That is, the calorific powers generated from the individual heaters 631, 632 and 633 are transferred to the plating liquid L1 on the substrate W, so that the temperature of the plating liquid L1 is increased. Here, the calorific powers per unit area of the inner heater 631 and the outer heater 632 are set to be larger than the calorific power per unit area of the intermediate heater 633. As a result, the heat amounts supplied to the plating liquid L1 at the inner periphery side portion and the outer periphery side portion on the substrate W are increased. Thus, temperatures of the parts of plating liquid L1, which are relatively difficult to increase, can be increased effectively, so that the temperature of the plating liquid L1 can be uniformed.

The heating of the plating liquid L1 in the first heating process is performed for a preset time period until which the temperature of the plating liquid L1 is allowed to rise to a predetermined temperature. If the temperature of the plating liquid L1 reaches a temperature where a component of the plating liquid L1 is precipitated, the component of the plating liquid L1 is precipitated on the top surface of the substrate W, so that the plating film P begins to be formed.

In the first heating process, however, the space between the cover body 6 and the cup 571 is narrow. Thus, the supply amount of the air supplied to the vicinity of the cover body 6 from the fan filter unit 59 is set to be smaller than the supply amount of the air in the plating liquid accumulating process (process S4). Accordingly, the velocity of the air passing through the space between the cover body 6 and the cup 571 is reduced, and the cover body 6 can be suppressed from being cooled by the air passing there. Furthermore, while the cover body 6 is located at the first gap position, the substrate W is covered by the cover body 6 as stated above, so that the vaporization of the plating liquid L1 is suppressed. Therefore, even if the supply amount of the air is reduced, the diffusion of the gas vaporized from the plating liquid L1 to the vicinity thereof can be suppressed.

<Second Heating Process>

After the first heating process is completed, the second heating process is performed (process S8). In this case, as depicted in FIG. 9D, as the cylinder 73 of the cover body moving device 7 is driven, the cover body 6 located at the first gap position is raised to be placed at the second gap position. Accordingly, the gap between the substrate W and the first ceiling plate 611 of the cover body 6 is set to the second gap g2. In this case as well, the sidewall unit 62 of the cover body 6 is positioned near the outer periphery side of the substrate W, and the lower end 621 of the sidewall unit 62 is located at a position lower than the bottom surface of the substrate W. Accordingly, the substrate W is still covered by the cover body 6, so that the space around the substrate W is sealed.

In this second heating process as well, as the inner heater 631, the outer heater 632 and the intermediate heater 633 are driven, the plating liquid L1 accumulated on the substrate W is heated. Calorific powers generated from the individual heaters 631, 632 and 633 are transferred to the plating liquid L1. The temperature of the plating liquid L1, however, is not actually increased but maintained at the same temperature as it is when the first heating process is completed, so that the plating liquid L1 is kept warm. That is, the second gap position is set to a position where the temperature of plating liquid L1 is kept warm. Therefore, as an excessive temperature rise of the plating liquid L1 is suppressed, the degradation of the plating liquid L1 can be suppressed.

In the second heating process, as stated above, the cover body 6 is raised from the first gap position to the second gap position. Accordingly, the atmosphere of the inside of the sidewall unit 62 moves up as the cover body 6 is raised, and reaches the vicinity of the substrate W. The lower end 621 of the sidewall unit 62 in the first heating process is placed at a position lower than the lower end 621 of the sidewall unit 62 in the second heating process. Therefore, the atmosphere, which reaches the vicinity of the substrate W as the cover body 6 is raised, is previously heated inside the cover body 6 in the first heating process. As a result, in the second heating process, the decrease of the temperature of the atmosphere around the substrate W can be suppressed.

The heating of the plating liquid L1 in the second heating process is performed for a preset time period during which the plating film P having a preset thickness is obtained. During this time period, a component of the plating liquid L1 is precipitated, so that the plating film P is grown on the substrate W.

Furthermore, as in the first heating process, the space between the cover body 6 and the cup 571 is narrow in the second heating process. Accordingly, the supply amount of the air supplied from the fan filter unit 59 is set to be smaller than the supply amount of the air in the plating liquid accumulating process (process S4), as in the first heating process (process S7).

Meanwhile, in the plating liquid heating process, the heat amounts generated from the heaters 631, 632 and 633 may be transferred to the rotation motor 523 as well. As stated above, however, the cooling liquid CL is flown in the cooling groove 525*a* of the cooling plate 525. Accordingly, the rotation motor 523 is cooled, so that the temperature rise of the rotation motor 523 is suppressed.

<Cover Body Retreating Process>

Upon the completion of the second heating process, the cover body moving device 7 is driven, and the cover body 6 is moved to the retreat position (process S9). In this case, as the cylinder 73 of the cover body moving device 7 is driven, the cover body 6 located at the second gap position is raised to be placed at the up position. Thereafter, the swing motor 72 of the cover body moving device 7 is driven, and the cover body 6 placed at the up position is rotated in the horizontal direction and moved to the retreat position.

When the cover body 6 is raised from the second gap position, the supply amount of the air supplied from the fan filter unit 59 is increased back to the same supply amount of the air in the plating liquid accumulating process (process S4). As a result, the flow rate of the air flowing in the vicinity of the substrate W is increased, so that the moving up and diffusion of the gas vaporized from the plating liquid L1 is suppressed.

Through the above-stated operations, the plating liquid heating process (processes S5 to S9) on the substrate W is ended.

[Substrate Rinsing Process]

Subsequently, the substrate W on which the plating liquid heating process is performed is rinsed (process S10). In this case, first, the rotational speed of the substrate W is increased higher than the rotational speed in the plating processing. For example, the substrate W is rotated at the same rotational speed as in the substrate rinsing process (process S3) performed before the plating processing. Subsequently, the rinse liquid nozzle 551 placed at the retreat position is moved to the discharge position. Then, the rinse liquid L3 is supplied from the rinse liquid nozzle 551 onto the substrate W being rotated, so that the surface of the substrate W is cleaned. As a result, the plating liquid L1 remaining on the substrate W is washed away.

[Substrate Drying Process]

Figure 9E:
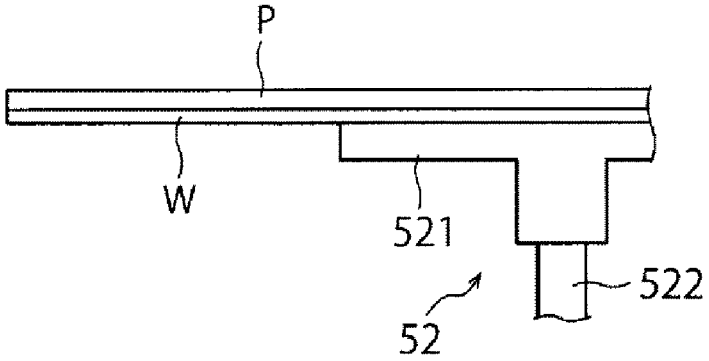
FIG. 9E is a diagram for describing a substrate drying process of FIG. 8.

Thereafter, the rinsed substrate W is dried (process S11). In this case, the rotational speed of the substrate W is increased higher than the rotational speed in the substrate rinsing process (process S10), for example, and the substrate W is rotated at a high speed. As a result, the rinse liquid L3 remaining on the substrate W is removed by being dispersed away, so that the substrate W having thereon the plating film P is finally obtained, as shown in FIG. 9E. Here, it may be possible to facilitate the drying of the substrate W by blowing the inert gas such as a nitrogen ($N_2$) gas to the substrate W.

[Substrate Carrying-Out Process]

Then, the substrate W is taken from the substrate holding unit 52 and is carried out of the plating device 5 (process S12).

Through the above-described processes, the plating method of the substrate W (the series of processes 51 to S12) using the plating apparatus 1 is ended.

During the various kinds of liquid processings on the substrate W stated above, the processing liquids supplied to the substrate W are introduced into the drain duct 581, as shown in FIG. 2. Though the processing liquids introduced into the drain duct 581 is recovered into a non-illustrated recovery unit, there may be assumed a case where the processing liquid is still stored in the drain duct 581 for some reason. In this case, if the liquid surface of the processing liquid stored in the drain duct 581 rises and reaches an upper end of the exhaust lines 81, the processing liquid may flow into the exhaust duct 82 through the exhaust lines 81. The processing liquid introduced into the exhaust duct 82 is stored in the duct recess 823 of the exhaust duct 82 shown in FIG. 6 and FIG. 7. If the storage amount of the processing liquid in the duct recess 823 exceeds a preset reference amount, the liquid surface of the processing liquid is detected by the liquid surface sensor 84.

If the liquid surface sensor 84 detects the liquid surface of the processing liquid, the liquid drain pump 831 of the liquid drain line 83 is driven, and the processing liquid stored in the duct recess 823 is drained. Thereafter, the duct cleaning liquid is discharged from the duct nozzle 86, and the inside of the exhaust duct 82 is cleaned by the discharged duct cleaning liquid. The duct cleaning liquid used to clean the inside of the exhaust duct 82 is drained through the liquid drain line 83. Thus, even if the processing liquid flows into the exhaust duct 82, the exhaust duct 82 can be cleaned and maintained clean. Furthermore, since a pressure within the exhaust duct 82 is detected by the pressure sensor 85, the duct cleaning liquid may be discharged from the duct nozzle 86 if the detected pressure exceeds a preset reference pressure value. Thus, the inside of the exhaust duct 82 can be cleaned and maintained clean.

As stated above, according to the present exemplary embodiment, when heating the plating liquid L1 on the substrate W, the ceiling unit 61 of the cover body 6 is placed above the substrate W, and the sidewall unit 62 of the cover body 6 is placed near the outer periphery side of the substrate W. Accordingly, the substrate W is covered by the cover body 6, and the space around the substrate W can be sealed. Thus, the diffusion of the atmosphere around the substrate W can be suppressed. As a consequence, by increasing the temperature of the plating liquid L1 on the substrate W rapidly, the degradation of the plating liquid L1 can be suppressed, and the plating processing of the substrate W can be uniformed. Furthermore, since the substrate W is covered by the cover body 6, the vaporization of the plating liquid L1 on the substrate W can be suppressed. Therefore, a loss of the plating liquid L1 on the substrate W caused by the vaporization of the plating liquid L1 can be suppressed, and the plating film P can be formed efficiently. Furthermore, since the vaporization of the plating liquid L1 can be suppressed, the consumption amount of the plating liquid L1 can be reduced, and, also, condensation of the plating liquid L1 within the chamber 51 can be suppressed.

Moreover, according to the present exemplary embodiment, when heating the plating liquid L1 on the substrate W, the lower end 621 of the sidewall unit 62 of the cover body 6 is located at the position lower than the substrate W. Accordingly, the diffusion of the atmosphere around the substrate W can be further suppressed. Therefore, the temperature of the plating liquid L1 can be increased more rapidly and more uniformly.

In addition, according to the present exemplary embodiment, when heating the plating liquid L1 on the substrate W, the gap between the substrate W onto which the plating liquid L1 is supplied and the first ceiling plate 611 of the cover body 6 is adjusted to the first gap g1 and, then, to the second gap g2. Thus, after increasing the temperature of the plating liquid L1 by heating the plating liquid L1 while setting the gap between the substrate W and the first ceiling plate 611 to the first gap g1, the plating liquid L1 whose temperature is increased can be kept warm by setting the gap to the second gap g2. Therefore, the excessive temperatures rise of the plating liquid L1 can be avoided, so that the degradation of the plating liquid L1 can be further suppressed.

Furthermore, according to the present exemplary embodiment, even in case that the gap between the substrate W and the first ceiling plate 611 is set to the second gap g2 in order to keep the plating liquid L1 warm as well as in case that the gap is set to the first gap g1, the lower end 621 of the sidewall unit 62 of the cover body 6 is located lower than the substrate W. Accordingly, the plating liquid L1 can be kept warm efficiently, and the temperature of the plating liquid L1 can be uniformed.

Moreover, according to the present exemplary embodiment, the heater 63 is embedded between the first ceiling plate 611 and the second ceiling plate 612 of the cover body 6. Accordingly, the contact between the heater 63 and the processing liquid such as the plating liquid L1 can be avoided. Therefore, the heater 63 does not need to have chemical resistance against the processing liquid such as the plating liquid L1.

In addition, according to the present exemplary embodiment, the calorific powers per unit area of the inner heater 631 and the outer heater 632 are set to be larger than the calorific power per unit area of the intermediate heater 633. Here, the plating liquid L1 on the inner periphery side portion of the substrate W tends to be difficult to heat by being affected by the chuck member 521 of the substrate holding unit 52, which is of the vacuum chuck type. Further, the plating liquid L1 on the outer periphery side portion of the substrate W tends to be difficult to heat by being affected by the atmosphere around the cover body 6. According to the present exemplary embodiment, however, the heat amounts applied to the plating liquid L1 on the inner periphery side portion and the outer periphery side portion of the substrate W can be increased higher than that applied to the plating liquid L1 on the intermediate side portion (between the inner periphery side portion and the outer periphery side portion). Therefore, the decrease of the temperature rising rate of the plating liquid L1 on the inner periphery side portion and the outer periphery side portion of the substrate W can be suppressed, so that the temperature of the plating liquid L1 can be uniformed.

Additionally, according to the present exemplary embodiment, the cover body cover 64 covering the ceiling unit 61 and the sidewall unit 62 of the cover body 6 has higher heat insulation property than the ceiling unit 61 and the sidewall unit 62. Therefore, the heat inside the cover body 6 can be suppressed from being leaked to the vicinity, so that the temperature of the plating liquid L1 can be increased more rapidly and more uniformly.

Further, according to the present exemplary embodiment, the inert gas can be supplied to the inside of the cover body 6 by the inert gas supply unit 66. Therefore, the atmosphere inside the cover body 6 can be turned into the low oxygen atmosphere, so that the oxide film on the plating film P formed on the substrate W can be suppressed from being formed.

Furthermore, according to the present exemplary embodiment, the supply amount of the gas from the fan filter unit 59 at the time when the plating liquid L1 on the substrate W is heated by the heater 63 is set to be smaller than the supply amount of the gas at the time when the plating liquid L1 is supplied to the substrate W. Accordingly, the velocity of the air flowing in the vicinity of the cover body 6 when the plating liquid L1 is heated can be reduced, so that the cooling of the cover body 6 by this air can be suppressed. Therefore, the temperature of the plating liquid L1 can be increased more rapidly and more uniformly.

In addition, the above exemplary embodiment has been described for the case where the gap between the substrate W and the first ceiling plate 611 is adjusted as the cover body 6 is moved by the cylinder 73 of the cover body moving device 7 in the vertical direction with respect to the substrate W held by the substrate holding unit 52. However, the exemplary embodiment is not limited thereto. By way of example, the gap between the substrate W and the first ceiling plate 611 may be adjusted by moving the substrate W along with the substrate holding unit 52 in the vertical direction with respect to the cover body 6.

Moreover, the above exemplary embodiment has been described for the case of heating the plating liquid L1 supplied on the substrate W. However, the processing liquid to be heated is not limited to the plating liquid L1. By way of example, if cleaning performance of the cleaning liquid L2 can be increased by increasing the temperature thereof, the cleaning liquid L2 may be heated. In this case, after the cleaning liquid L2 is supplied on the substrate W, the substrate W may be covered with the cover body 6 and the cleaning liquid L2 supplied on the substrate W may be then heated.

Further, in the above-described exemplary embodiment, the plating liquid nozzle 531 is held by the nozzle arm 56 along with the cleaning liquid nozzle 541 and the rinse liquid nozzle 551. However, the exemplary embodiment is not limited to this example, and the plating liquid nozzle 531 may be provided at the ceiling unit 61 of the cover body 6. In such a case, the plating liquid accumulating process (process S4) may be performed after covering the substrate W with the cover body 6. In this case, the vaporization of the plating liquid L1 can be further suppressed, and the consumption amount of the plating liquid L1 can be further reduced.

Furthermore, in the above-described exemplary embodiment, the gas nozzle 661 configured to supply the inert gas is provided at the ceiling unit 61 of the cover body 6, and the inert gas is supplied to the inside of the cover body 6. However, the arrangement of the gas nozzle 661 is not limited to the ceiling unit 61 of the cover body 6 as long as the space inside the cover body 6 can be set into the low oxygen atmosphere.

Moreover, in the above-described exemplary embodiment, a second heater (not shown) may be provided at the sidewall unit 62 of the cover body 6. In this case, the temperature rise of the plating liquid L1 on the substrate W can be accelerated.

Additionally, the above exemplary embodiment has been described for the case where the substrate holding unit 52 is of the vacuum chuck type. In this case, the substrate W may be heated by supplying a heating medium to the rear surface of the substrate W, and the temperature rise of the plating liquid L1 on the substrate W can be accelerated.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting. The scope of the inventive concept is defined by the following claims and their equivalents rather than by the detailed description of the exemplary embodiments. It shall be understood that all modifications and embodiments conceived from the meaning and scope of the claims and their equivalents are included in the scope of the inventive concept.

We claim:

1. A substrate liquid processing apparatus configured to perform a liquid processing on a substrate by supplying a processing liquid onto the substrate, the substrate liquid processing apparatus comprising:

a substrate holding unit configured to hold the substrate;

a processing liquid supply unit configured to supply the processing liquid onto a top surface of the substrate held by the substrate holding unit; and a cover body configured to cover the substrate held by the substrate holding unit, wherein the cover body comprises a ceiling unit disposed above the substrate, a sidewall unit downwardly extended from the ceiling unit, and a heating unit provided at the ceiling unit and configured to heat the processing liquid on the substrate, the sidewall unit of the cover body is placed at an outer periphery side of the substrate when the processing liquid on the substrate is heated, the cover body further comprises a cover body cover attached to the ceiling unit with a supporting portion therebetween and configured to cover the ceiling unit such that heat within the cover body is suppressed from being leaked.

2. The substrate liquid processing apparatus of claim 1, wherein a lower end of the sidewall unit is located at a position lower than the substrate when the processing liquid on the substrate is heated.

3. The substrate liquid processing apparatus of claim 1, further comprising:

a gap adjusting unit configured to adjust a gap between the ceiling unit and the substrate on which the processing liquid is supplied, wherein the gap adjusting unit is configured to adjust the gap to a first gap and to a second gap larger than the first gap when the processing liquid on the substrate is heated.

4. The substrate liquid processing apparatus of claim 3, wherein a lower end of the sidewall unit is located at a position lower than the substrate when the gap is set to the second gap.

5. The substrate liquid processing apparatus of claim 1, wherein the ceiling unit comprises a first ceiling plate and a second ceiling plate provided on the first ceiling plate, and the heating unit is embedded between the first ceiling plate and the second ceiling plate.

6. The substrate liquid processing apparatus of claim 1, wherein the heating unit comprises an inner heating unit, an outer heating unit provided at an outer periphery side than the inner heating unit, and an intermediate heating unit provided between the inner heating unit and the outer heating unit, and a calorific power per unit area of at least one of the inner heating unit and the outer heating unit is larger than a calorific power per unit area of the intermediate heating unit.

7. The substrate liquid processing apparatus of claim 1, wherein the cover body cover is further configured to cover the sidewall unit, and the cover body cover has higher heat insulation property than the ceiling unit and the sidewall unit.

8. The substrate liquid processing apparatus of claim 1, further comprising:

an inert gas supply unit configured to supply an inert gas to an inside of the cover body.

9. The substrate liquid processing apparatus of claim 1, further comprising:

a gas supply unit configured to supply a gas to a vicinity of the cover body, wherein a supply amount of the gas from the gas supply unit at a time when the processing liquid on the substrate is heated by the heating unit is set to be smaller than a supply amount of the gas at a time when the processing liquid is supplied onto the substrate.

10. The substrate liquid processing apparatus of claim 1, wherein the processing liquid supply unit comprises a processing liquid nozzle configured to discharge the processing liquid onto the substrate, and the processing liquid nozzle is provided at the ceiling unit.

11. The substrate liquid processing apparatus of claim 1, wherein the processing liquid is a plating liquid.

* * * * *